United States Patent [19]

Kaneda

[11] 4,238,708

[45] * Dec. 9, 1980

[54] DISCHARGE LAMP OPERATING SYSTEM

[75] Inventor: Isao Kaneda, Otsu, Japan

[73] Assignee: New Nippon Electric Company, Ltd., Osaka, Japan

[ * ] Notice: The portion of the term of this patent subsequent to Mar. 14, 1995, has been disclaimed.

[21] Appl. No.: 873,241

[22] Filed: Jan. 30, 1978

Related U.S. Application Data

[63] Continuation-in-part of Ser. No. 646,957, Jan. 7, 1976, Pat. No. 4,079,292.

[30] Foreign Application Priority Data

Feb. 2, 1977 [JP] Japan ..... 52-11040
Mar. 17, 1977 [JP] Japan ..... 52-30065

[51] Int. Cl.[2] ..... H05B 41/16

[52] U.S. Cl. ..... 315/289; 315/105; 315/244; 315/284; 315/DIG. 2

[58] Field of Search ..... 315/101, 105, 274, 276, 315/283, 284, 289, 290, DIG. 2, DIG. 5, 244, DIG. 7

[56] References Cited

U.S. PATENT DOCUMENTS

| | | | |
|---|---|---|---|
| 3,466,500 | 9/1969 | Peek | 315/DIG. 7 |
| 3,665,243 | 5/1972 | Kaneda et al. | 315/242 X |
| 3,753,037 | 8/1973 | Kaneda et al. | 315/244 X |
| 3,997,814 | 12/1976 | Toho | 315/200 R |
| 4,023,066 | 5/1977 | Smulders | 315/209 R |
| 4,066,932 | 1/1978 | Rottier | 315/244 |
| 4,079,292 | 3/1978 | Kaneda | 315/289 |

*Primary Examiner*—Eugene R. LaRoche
*Attorney, Agent, or Firm*—W. G. Fasse; D. F. Gould

[57] ABSTRACT

A discharge lamp is ignited in every half cycle in its operating system including a discharge lamp operating circuit provided with a low frequency alternating current power source, a single winding type current limiter. The discharge lamp is connected to the power source through the current limiter and a series circuit including a high voltage output generator is connected in parallel to the discharge lamp. The high voltage output generator operates during the lamp operation for reigniting the discharge lamp. The voltage of the low frequency alternating current power source is set to less than the required reignition voltage of the discharge lamp during its operation, whereby the lamp current stabilizer size is minimized. Further, a filament preheating circuit is arranged to use current derived from the high voltage generator. The filament preheating circuit is combined with this operating circuit and so is a time delay for assuring a stable operation.

14 Claims, 16 Drawing Figures

DISCHARGE LAMP OPERATING SYSTEM

CROSS REFERENCE TO RELATED APPLICATIONS

The present application is a continuation in part application of copending application U.S. Ser. No. 646,957 filed Jan. 7, 1976 now U.S. Pat. No. 4,079,292.

BACKGROUND OF THE INVENTION

This invention relates to a discharge lamp operating system wherein the discharge lamp means is ignited by a high voltage in every half cycle of an a.c. power source in its continued operation. More particularly the invention relates to a combination of a single choke ballast and an electronic preheating circuit forming part of the "every half cycle" ignited system.

In recent years, energy optimization and the saving of energy resources have been the prime targets of technology. The present so-called "every half cycle" ignited discharge lamp operating system intends to find a solution for the saving of energy in the field of illumination. For example, in an article "An Investigation of Minimized Ballast upon Every-half-cycle Ignited Discharge Lamp Operating System with Analogue Computer Simulation" published in the Journal of Light and Visual Environment (Vol 1, No. 1, 1977) by the Illuminating Engineering Institute of Japan, there are disclosed theoretically estimated improvements in the power loss and the weight reduction. The power loss is reduced to one third and even up to one forth, as compared to the rapid start type. The weight reduction is to one fourth and even to only one eleventh compared to those of conventional switch-start or rapid-start discharge lamp operating devices. Thus, a substantial miniaturization of such device has been realized according to said article. To facilitate the understanding of how the current limiting choke, which is used in the "every half cycle ignited discharge lamp operating system" of the present invention, is miniaturized, the function of the conventional discharge lamp operating system be explained first. As shown in U.S. Pat. Nos. 3,665,243; 3,753,073; 3,866,088; and 3,942,069, a conventional fluorescent lamp operating device is constructed, for instance, of a circuit shown in FIG. 1, wherein the discharge lamp FL is connected in series with the current limiting choke CH, which acts as a current limiting device, and to an a.c. power source AC and the oscillation circuit or oscillator R1 is connected to the lamp FL in parallel. When the power source AC is turned on, the oscillator R1 starts oscillation and hence heating the filaments fa and fc of the lamp FL by its oscillation current. The oscillation output voltage which is higher than the required starting voltage Est, is applied across the filaments of the lamp. When the filaments fa and fc are sufficiently heated and the required starting voltage for the lamp FL becomes lower than Est, the lamp is ignited by the above-described oscillation output and begins a lag-phase operation. Once the lamp is lit, the terminal voltage vT, i.e. the lamp voltage of the discharge lamp FL corresponds to about one half of the source voltage. Hence, the oscillator R1 can no longer continue to oscillate, and the discharge lamp FL is operated by the voltage supplied from the power source AC through the current limiting choke CH.

FIG. 2 (A), (B), and (C) show the waveforms of the source voltage "e", the lamp voltage vT and the lamp current iT respectively obtained from observation of the lamp under operation. FIG. 2 (D) shows the product of the terminal voltage vCH of the current limiting choke CH which does not contain a resistive component, and the lamp current iT. FIG. 2 (E) shows the energy Se stored in the choke at each respective instant. As seen from these waveforms, for the period (t1-t2) in which the source voltage e is higher than the lamp voltage vT, the energy $Se1=\int_{t1}^{t2}(e-vT)iTdt$ increases monotonically and is stored in the current limiting choke CH. For the period (t2-t3) in which the source voltage e is lower than the lamp voltage vT, the stored energy is released and the released energy is expressed by $Se2=\int_{t2}^{t3}(e-vT)iTdt$. The size of the current limiting choke CH is determined by the maximum value of the stored energy Se shown in FIG. 2 (E). Thus, the capacity of the choke CH must be so selected as to endure the maximum amplitude Semax of the stored energy.

In the just described case, the required reignition voltage Erst of the discharge lamp FL must be lower than the source voltage e at the reignition instant. In other words, the peak value vTP of the lamp voltage vT must not exceed the source voltage e. Since in the conventional discharge lamp the effective value VT of the lamp voltage is set at about ½ of that of the source voltage e, the effective value VCH of the terminal voltage of the current limiting choke is set higher than the ½ of the source voltage.

My U.S. Pat. 4,079,292 granted on Mar. 14, 1978, discloses an "every half cycle ignited discharge lamp operating system", and present FIG. 3 shows one example of such operating circuits for a fluorescent lamp. In FIG. 3 the current limiting choke CH and the discharge lamp FL, connected in a series circuit, are connected to an a.c. power source AC. The current limiting choke is provided with a secondary winding W20 which superposes the oscillation output of the booster circuit as a high voltage generating means, on the power source voltage, and one end of the secondary winding W20 is connected to a junction j1 of the filament fa of the discharge lamp FL. The other end of the winding W20 is connected to the booster circuit or booster R.

The booster R is a series connection of an intermittently oscillating capacitor C1 and an oscillator R1 which is connected in a parallel circuit of an oscillation capacitor C and a series connection of a bidirectional diode thyristor S and a backswing voltage generating or boosting inductor L. One end of the booster circuit R is connected to the other end of the secondary winding W20. The other end of the booster R is connected to a junction j2 of the filament fc of the discharge lamp FL. In addition, the booster R may be, so far as it operates as a high frequency oscillator, replaced by a circuit which employs a gated type thyristor such as a TRIAC or by an inverter or a high voltage generating circuit which employs a pulse generator.

The above circuit operates as follows. When the power source AC is turned on, the source voltage e is applied to the discharge lamp FL through the current limiting choke CH and to the booster R through the secondary winding W20. In the booster R the source voltage e is applied to the thyristor S through the intermittently oscillative capacitor C1, then the oscillator R1 starts oscillation in order to break over the thyristor. Without the intermittently oscillating capacitor C1 the oscillation would continue once generated, but in the circuit shown here due to the capacitor C1, the oscillation occurs repeatedly at every half cycle in the leading portion of the source voltage e.

After the oscillator R1 starts oscillation, the capacitor C1 is charged with such polarity that it cancels the source voltage e. Thus, as the terminal voltage VC1 rises and the voltage difference of the terminal and the source voltage e becomes insufficient relative to the break-over voltage VBO of the thyristor S, the latter assumes the off-state, hence the oscillator R1 ceases to oscillate. Therefore, the terminal voltage vc1 of the capacitor C1 remains constant and the oscillator R1 is in the non-oscillating state during the later period of the just described half cycle. In the next half cycle, where the source voltage e is reversed compared to the preceding half cycle, the summed up voltage of the source and the terminal voltage vc1 which charged the capacitor C1 during the preceding half cycle, is impressed on the oscillator R1, which causes the break-over of the thyristor and hence again an oscillation. However, from the moment when the oscillation starts again, the intermittently oscillating capacitor C1 begins to be charged to compensate the source voltage e again and the polarity of the terminal voltage vc1 of the capacitor C1 is rapidly reversed. In the meantime the oscillator R1 again stops oscillating. The oscillator R1, therefore, operates exclusively during the period of the inversion of the voltage of the intermittently oscillating capacitor C1. Thus, the current flows from the source AC to the oscillator R1 through the primary W10 and the secondary winding W20 of the ballast choke CH solely during this period. Such operational mode is repeated in the same way in every following half cycle. FIG. 4 (A) is a voltagecurrent waveform showing the above described operation, wherein e is the source voltage and vc1 is the terminal voltage of the intermittently oscillating capacitor C1. As seen from this figure, the current ic1 flows to the capacitor C1 in the period of the rapid inversion of the terminal voltage, and just in this period also appears the oscillation output vR of the high frequency high voltage across both ends of the booster R.

The above described oscillation output vR is blocked by the primary W10 and the secondary winding W20 of the current limiting choke CH. The terminal voltage of the primary winding W10 is superposed on the source voltage e, and the summed up voltage is impressed on the discharge lamp FL and the filament preheating circuit PRH. Thus, in the filament preheating circuit PRH the voltage is impressed on the thyristor SP through the high frequency blocking inductor NL, then the thyristor SP is driven to conduct by the sudden change effect (dV/dt effect) of the voltage. Therefore, at the end of the intermittently oscillative phase, the current flows from the source AC through the filament fa, the thyristor SP, the inductor NL and the filament fc, so as to initiate the preheating of the filaments fa and fc. Each time when the oscillation output vR of the booster R is applied to the preheating circuit PRH, the thyristor SP is driven to conduct and the preheating is repeated during this period by the current flow from the source AC to the filaments fa and fc.

When the filaments fa and fc are sufficiently preheated and the voltage required to start the discharge lamp FL becomes the starting voltage Est, the discharge lamp FL is triggered to start by the oscillation output vR from the booster circuit R. After the discharge lamp FL is lit, the intermittent oscillation energy flows mainly through the conducting discharge lamp FL and the remaining energy is absorbed by the high frequency blocking inductor NL. By setting the breakover voltage VBO of the thyristor SP sufficiently high above the peak voltage vTP of the lamp voltage, the thyristor does not conduct. In addition, in the case where the breakover voltage of the thyristor is set considerably high, if required, the high frequency blocking inductor NL can be omitted. After the lamp is lit, the filament preheating does not occur, hence, the discharge lamp FL is ignited by the oscillation output vR at every half cycle of the power source AC and operated solely by the source voltage e as referred to in FIG. 4 (B). In addition, the preheating circuit PRH of FIG. 3 may be replaced by a filament preheating transformer.

FIG. 5 shows the waveforms of each instant observed in the experiment using the circuit of FIG. 3, wherein the high frequency component is neglected. As seen from FIG. 5 (B), the lamp voltage vT is a nearly rectangular waveform having a pause period due to the intermittently oscillating period. Thus, the effective value VT of the lamp voltage is about 90–95% of the conventional lighting system. The discharge lamp FL is reignited at the step-up portion of every half cycle by the high voltage oscillation output vR in the following way. As the intermittent current ic1 originating from the booster circuit flows through the secondary winding W20, the corresponding terminal voltage of the winding is applied through the coupling with the primary winding W10, as a rapidly rising low frequency voltage, to the discharge lamp FL, whereby a sufficient quantity of ions are generated in the lamp, which is helpful for its easy breakdown, thus, resulting in the arc discharge of the lamp. Further in this case, the lamp current iT remains constant in the step-up, in spite of the change of the source voltage e, and as the lamp current iT increases, the above current ic1 decreases due to the encroachment of the edge of the lamp current waveform into the next half cycle. Hence, the initial value of the lamp current is controlled to be rather low by the rapidly growing low frequency voltage. Consequently, the fluctuation of the lamp current of the every half cycle ignited operating system is excellent regardless of the decrease in the stabilizing impedance.

The lamp current from the power source AC to the discharge lamp FL flows, for the most part, during the period (t2–t4) outside of the oscillation period, as shown in FIG. 5 (C). During the periods (t1–t2) and (t4–t5), the current ic1 flows from the source AC to the booster R. The waveform ic1 is shown in FIG. 5 (D). This current flows both through the primary winding W10 and the secondary winding W20, which are coupled together by the current limiting choke CH in a magnetism increasing manner or direction. The exciting or energizing effect can generally be varied by the winding ratio of the primary W10 to the secondary winding W20. FIGS. 5 (E) and (F) show the waveforms of the stored energy Se and the product (vCH.i) of the voltage of the current limiting choke CH calculated from the above described waveforms of the lamp volage vT, the lamp current iT, the current ic1 which flows into the booster R and the source voltage e. FIG. 5 (E) shows the voltage-current product of the current limiting choke CH caused by the voltage difference between the source voltage e and the oscillation output vR or the lamp voltage vT. The total stored energy Se1 due to the current ic1 is given by $\{Se1=\int_{t1}^{t2}(e-vR)Kicldt\}$, wherein K is a constant determined from the winding ratio of the primary W10 and the secondary winding W20. The stored energy Se2 for the period, where the source voltage e is higher than the lamp voltage vT, is given be $\{Se2 = \int_{t2}^{t3} (e - vT)iTdt\}$.

On the other hand, during the period (t3−t4), where the lamp voltage vT is higher than the source voltage e, the stored energy is released and the total released energy Se3 is given by $\{Se3 = \int_{t3}^{t4} (e - vT)iTdt\}$. Consequently, the energy, which is stored in the current limiting choke CH, is varied as shown in FIG. 5 (F). The relation Se1+Se2=Se3 applies to the waveforms shown in FIG. 5.

The calculations of the stored energy in the ballast of the conventional operating system and in the every half cycle operating system, are based on the waveforms shown in FIG. 2 and FIG. 5 respectively. The following relation is obtained, for instance, for the cases when a lamp of the 40T12 type is operated by the former conventional system with a 200 v linevoltage and the same lamp is operated by the latter in an "every half cycle system" with a 100 v line-voltage. The results may be compared as follows:

$$\left\{ \frac{\text{The maximum of every half cycle operated } Se1 + Se2 + Se3}{\text{The maximum of conventionally operated } Se1 + Se2} < \frac{1}{4} \right\} \text{ and}$$

$$\left\{ \frac{\text{Inductance of every half cycle system}}{\text{Inductance of conventional system}} < \frac{1}{5} \right\}$$

Thus, the current limiting choke CH of the latter can be reduced in impedance and in size accordingly.

Substantial advantages may thus be obtained from an "every half cycle ignited operating system" which is the aim of the invention so far described. However, still some problems remain to be solved. Namely, presently there are few discharge lamp types which have the lamp voltage equal to the source voltage. Therefore, an appropriate voltage difference exists in the conventionl type discharge lamps. In another aspect, since drawing out of the intermediate tap of the choke coil CH is necessary, such a structure imposes an unfavorable condition on its fully automated production.

Another problem is seen in that the preheating circuit means are rather complicated which also causes an economical disadvantage when one or more discharge lamps with filaments are to be operated. For instance, where a plurality of discharge lamps are to be employed in series, a preheating means which meets the requirements of small size, light weight and low cost cannot be realized satisfactorily with conventional preheating means employing the secondary windings of a heating transformer connected on the power source side of the discharge lamp means.

It has also been found to be somewhat difficult to maintain a stable operation in every half cycle due to the variation of the source voltage and/or the ambient temperature. The source voltage usually varies ±10% at its maximum. Further, the lamp voltage of the discharge lamp means varies according to the variation of the lamp current and ambient temperatures. For instance, as the ambient temperature falls or rises the lamp voltage goes down and it may happen that if the source voltage e goes up it reaches a value more than twice as high as the lamp voltage vT. On this occasion the discharge lamp may operate not according to the "every half cycle operational mode" but according to a conventional operational mode as illustrated in FIG. 1 and the discharge lamp operational mode shifts back ans forth between these two modes, resulting in a flickering light output and a greater stress on the current limiting means.

OBJECTS OF THE INVENTION

In view of the above it is the aim of the invention to achieve the following objects, singly or in combination:

to eliminate the above described problems, and to provide an every half cycle discharge lamp operating system having practical and economical advantages and to employ as current limiting means a single winding type choke coil or a single winding leakage type autotransformer;

to provide a discharge lamp operating system having a simplified filament preheating device which is a so-called electronic preheating means for operating discharge lamps of the hot cathode type;

to provide an every half cycle discharge lamp operating system employing time delay means to stabilize the operation against fluctuations of the source voltage and/or of the ambient temperatures.

to provide the above described discharge lamp operating system with sequentially operting starting means including high voltage output generating means or switching means where a plurality of discharge lamps are operated in series.

SUMMARY OF THE INVENTION

According to the invention there is provided a discharge lamp operating system, wherein the discharge lamp is connected to the low frequency a.c. power source thrugh a single winding current limiting device such as a single choke or a single leakage transformer and the booster circuit is connected in parallel to the discharge lamp and operates at least during the lamp operation and which supplies the reignition energy required for the lamp operation once the lamp is started. In other words, when the booster circuit is removed, the discharge lamp employed in the operating circuit of the present invention is extinguished.

According to another aspect of this invention a discharge lamp operating system employing a single winding type current limiting means is combined with a booster as a high frequency, high voltage output generating means which acts as an initial ignitor for the first ignition and as a repetitive ignitor for the second and further ignition functions. In this case a standard a.c. power source voltage which energizes and operates the discharge lamp and high voltage output generating or booster means, is set to a value below the reignition voltage or second ignition voltage of the discharge lamp. To this end, timing means re combined with the high voltage output generating means for determining the timing of the high voltage generation at a definite phase in every half cycle of the a.c. power source during the discharge lamp operation.

Where one or more discharge lamp means are provided with preheatable filaments, the invention avoids the use of filament preheating transformers and uses instead an electronic filament preheating circuit which uses current from and into the booster of the high voltage generating means. The electronic preheating circuit is so constructed that one or more oscillation capacitors or a series circuit of a boosting inductor and a thyristor are connected to the filaments of the discharge lamp means on the side opposite of the a.c. source. When the high voltage generating means or both the oscillation capacitor and the series circuit are connected to the opposite side of the source, the filament is preheated only by the input current of this circuit, hence the preheating effect is insufficient. However, if only the capacitor or the series circuit is connected to the side opposite of the source, a much greater preheating effect is achieved by a circular current which is produced by amplifying the input current. In other words, notwithstanding a small input current, the preheating circuit gives a greater amplified preheating current due to the function of an impedance conversion effect of the high voltage generating means. According to the thid aspect of this invention, means is added for regulating the ignition timing for activating the booster of the high voltage generating means prior to the reignition of the discharge lamp means. Thus, the present discharge lamp operating system assures the activation phase of the high voltages generating means prior to the ignition phase of the discharge lamp means by time delay means connected between the current limiting means and the discharge lamp means. In the fourth aspct of this invention, a lamp operating device is disclosed which operates sequentially a plurality of discharge lamp means connected in series, whereby the same effect is achieved as by the time delay means. This is accomplished by one or more bi-directional, two terminal thyristors as switching means for the high voltage output generating means and setting their effective break-over voltage below the lamp voltage of the discharge lamp means.

BRIEF FIGURE DESCRIPTION

FIG. 1 is a circuit diagram of a conventional discharge lamp operating device of a well known system;

FIGS. 2(A) to 2(E) show the waveforms of the circuit of FIG. 1;

FIG. 3 is a circuit diagram of a discharge lamp operating device of an "every half cycle ignited system" as disclosedin the above mentioned parent case;

FIGS. 4(A), 4(B) and 5(A) to 5(F) show waveforms of the circuit of FIG. 3 for the explanation of the "every half cycle ignited system";

Figure 1:
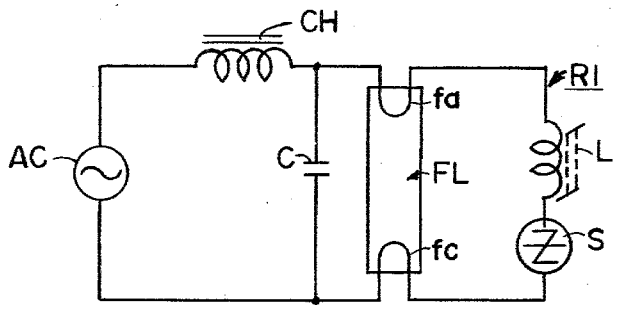
FIG. 1 (PRIOR ART)
Figure 2:
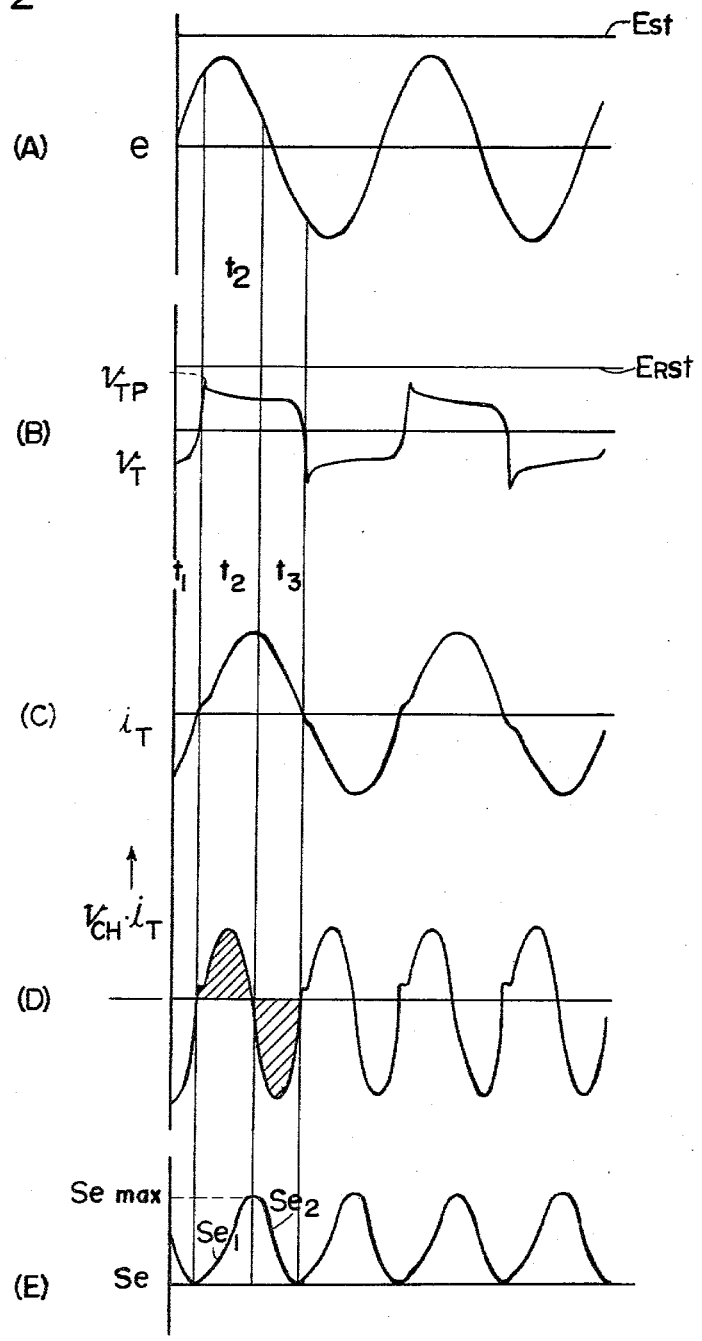
Figure 3:
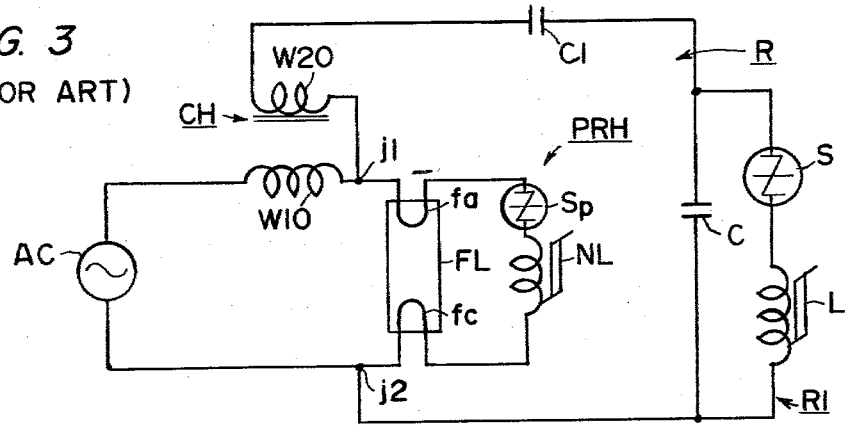
FIG. 3 (PRIOR ART)
Figure 6:
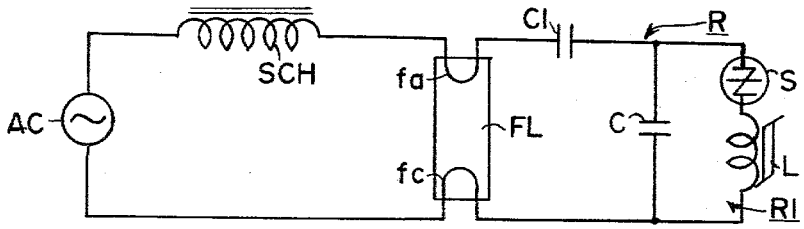
FIG. 6 is a circuit diagram of a basic embodiment of a discharge lamp operating device of the "every half cycle ignited system" according to this invention.

DETAILED DESCRIPTION OF PREFERRED EXAMPLE EMBODIMENTS:

FIG. 6 shows a basic circuit diagram of this invention. A fluorescent discharge lamp FL is connected to the low frequency a.c. power source AC, such as a standard or commercial power supply network, through a single choke SCH, and a series circuit of an intermittently oscillating capacitor C1. An oscillator R1 of the construction as shown in FIG. 3, is connected in parallel to the discharge lamp FL. The winding of the single winding choke SCH is so designed that it is approximately the same as the sum of the primary W10 and the secondary winding W20 of the choke coil CH in the previously proposed "every half cycle operating system" as shown in present FIG. 3. According to the present improvement, the source voltage e is so close to the lamp voltage vT that, if the oscillator R1 is removed, the operation of the discharge lamp FL cannot continue. The fluctuation characteristic of the lamp is thus further improved.

Figure 4:
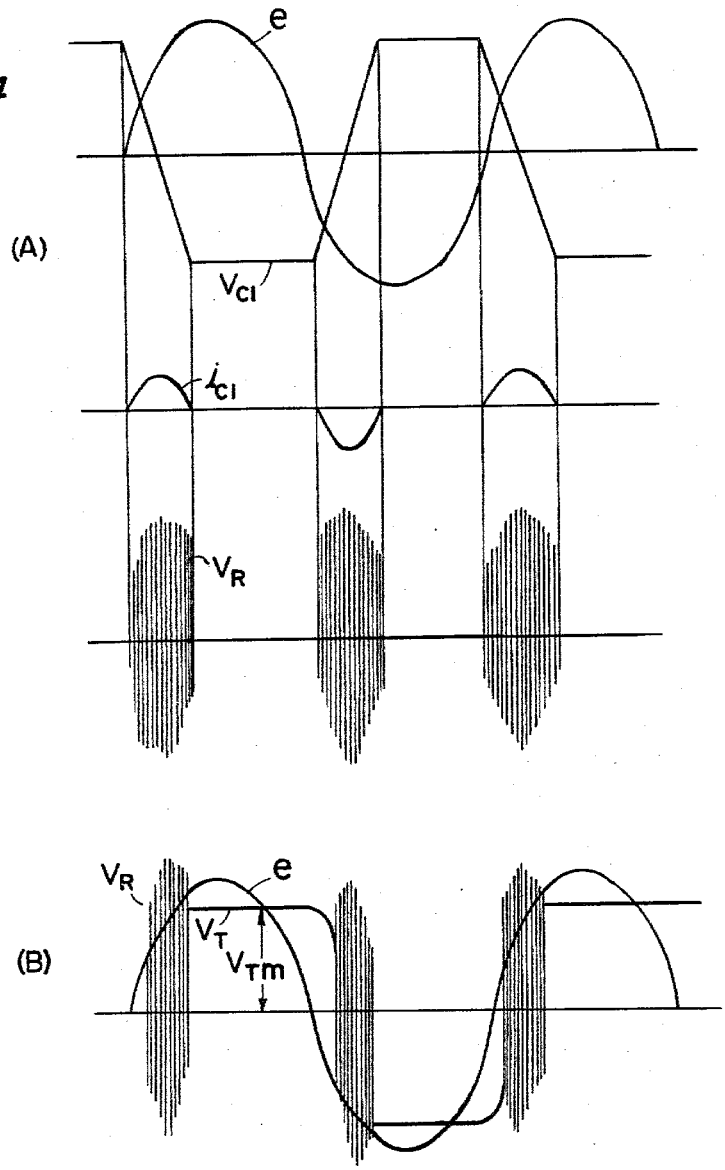
Figure 5:
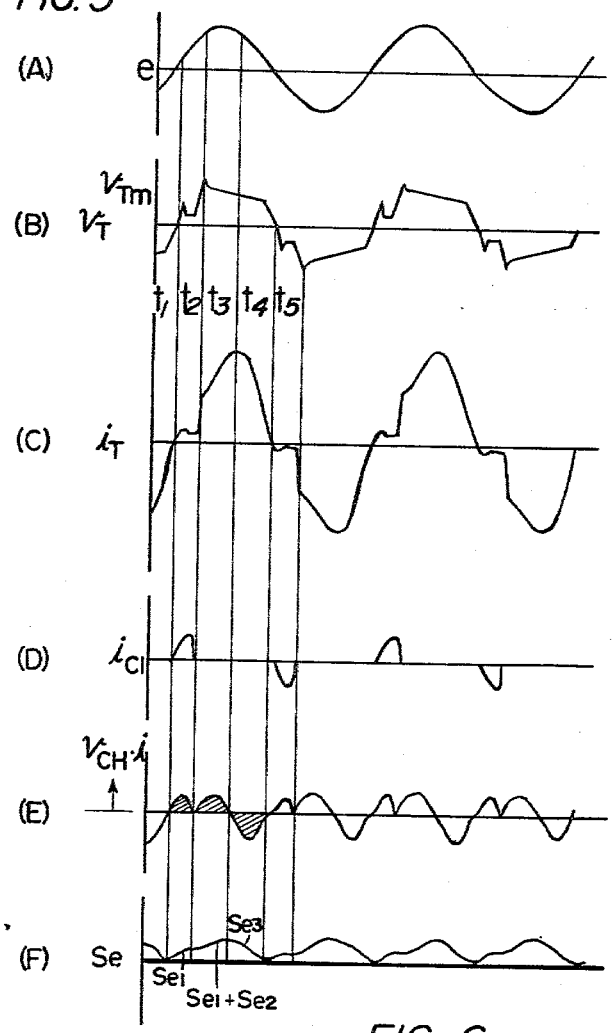
Figure 7:
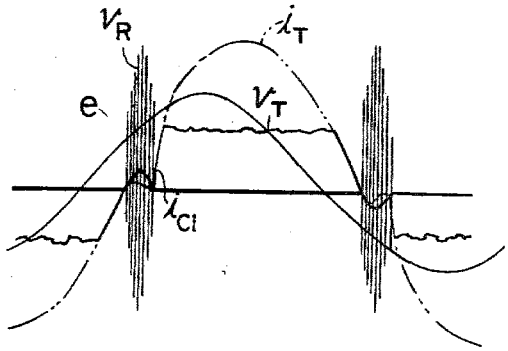
FIG. 7 shows the waveforms obtained when the circuit of FIG. 6 is operated in a first operational mode.
Figure 8:
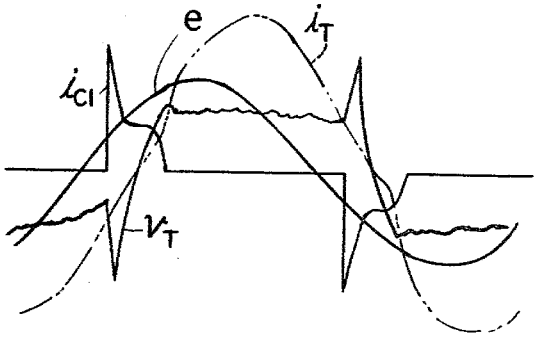
FIG. 8 shows the waveforms obtained when the circuit of FIG. 6 is operated in a second operational mode.

FIGS. 7 and 8 show the waveforms of each instant portion in the operation of the present invention. The first operational mode will now be explained with reference to FIG. 7. The first operational mode or "pattern I" is approximately the same as explained above with refernce to the circuit of FIG. 3 and the waveforms of FIGS. 4 and 5. Since, as viewed from the single choke SCH, the discharge lamp FL and the booster circuit R are conncted in parallel when the source AC is turned on, the voltage e is applied to the discharge lamp FL and to the booster circuit R through the single choke SCH. The thyristor S, which serves as a switching means for the oscillator R1, breaks over in resp9onse to the source voltage e, and then the oscillator R1 begins to oscillate. The oscillation output vR is derived intermittently from the booster R due to the intermittently oscillating capacitor C1, and is impressed on the discharge lamp FL immediately after every pause period of every half cycle of the lamp voltage vT or the lamp current iT. As described above, the inductance value of the single choke SCH is so designed, with reference to the intermittently oscillating capacitor C1, as to generate the intermittent oscillation. It is therefore required that the lamp current must not flow through the single choke coil SCH in the early period of the oscillation when it would be superposed on the input current; thus, the input current ic1 must exist prior to starting of the discharge lamp FL.

The second operational mode or "pattern II" will now be described with reference to FIG. 8, whereby the break-over voltage VBO of the thyristor S is selected to be lower than in the "pattern I" operation of FIG. 7. Consequently, when the source AC is turned on, the thyristor S breaks over even if the source voltage e is comparatively low. Hence, the operating phase of the oscillator R1 is expedited compared to the "pattern I" of FIG. 7. This means that when the thyristor S of the oscillator R1 is in the conduction state, a residual current iT (not zero) exists in the single choke, therefore, the inductance of this single choke SCH decreases. Therefore, the oscillation condition changes and the high frequency oscillation stops. At the phase or point of the ignition of the booster R, the lamp current iT decreases rapidly close to the zero level, then immediately, the input current i of the booster R begins to flow rapidly. Therefore, a pulse type high voltage is generated across the single choke SCH by the energy stored therein, which is expressed by $e=-L1(diT/dt)$, wherein L1 is the inductance of the single choke SCH. This pulse type voltage is impressed on the discharge lamp FL and enables its continuous operation. Consequently, in case of the "pattern II" operation once the discharge lamp FL starts, the high frequency high voltage cannot be obtained from the booster R, and the reignition energy for the discharge lamp FL is then provided in the form of a high voltage pulse. Hence the "patttern II" as compared to the "pattern I", is still advantageous even though the stability may be poor, because the high frequency oscillation ceases to operate once the discharge lamp FL is started, high frquency noise is thus reduced. In addition, according to the invention the phase angle is more advanced in the "pattern I" operation than in the "pattern II" operation described above.

Figure 9:
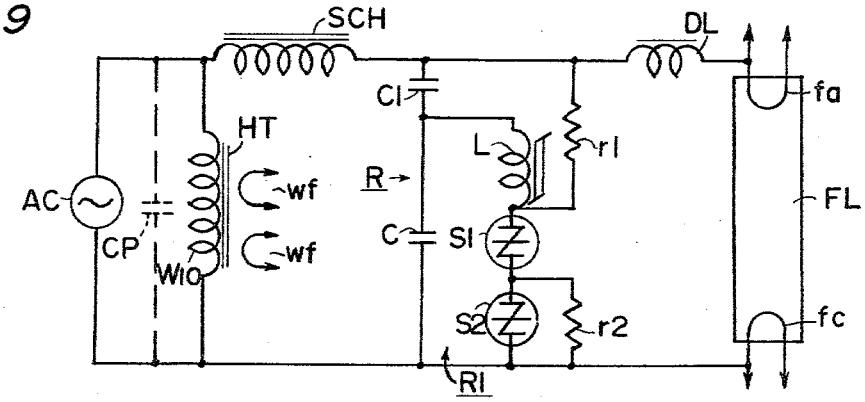
FIG. 9 is a circuit diagram of a practical embodiment according to this invention, which is suited for operation in the first operational mode using an oscillation output.

According to an example of the present invention, because the difference between the source voltage and the lamp voltage is slight, the choke coil employed as a current limiting device can be a single winding type, which realizes an extremely simple as well as a low cost production of the choke coil. FIG. 9 shows the electrical circuit diagram of another embodiment of the present invention, which is well suited for operating in accordance with "pattern I". FIG. 9 is substantially similar as the circuit of FIG. 6, except that a delaying inductor DL is connected between the booster R and the discharge lamp FL. This circuit is used for operating a relatively high power lamp, for instance, a 110 W fluorescent discharge lamp. The filaments fa and fc are each preheated by filament windings Wf of the heater transformer HT. In addition, two thyristors S1 and S2 are connected in series as switching means for the oscillator R1 to set the break-over voltage or capacity high. Also, a resistor r2 for promoting the starting is connected in parallel to one of the thyristors, namely, S2. Moreover, the stabilizing resistor r1 is connected in parallel to the boosting inductor L and the capacitor C1. If necessary, a capacitor CP for advancing phase is connected as shown in the circuit of FIG. 9.

The delaying inductor DL is employed for this discharge lamp operating device to be operated in the "pattern I" operational mode. Thus, the source voltage e is applied to the booster R through the single choke SCH, and to the discharge lamp FL also through the single choke SCH and through the delaying inductor DL which delays the ignition phase of the discharge lamp FL relative to the booster R. Thus, the booster R must operate before the discharge lamp FL starts. Hence, a stable "pattern I" operation is achieved.

Figure 10:
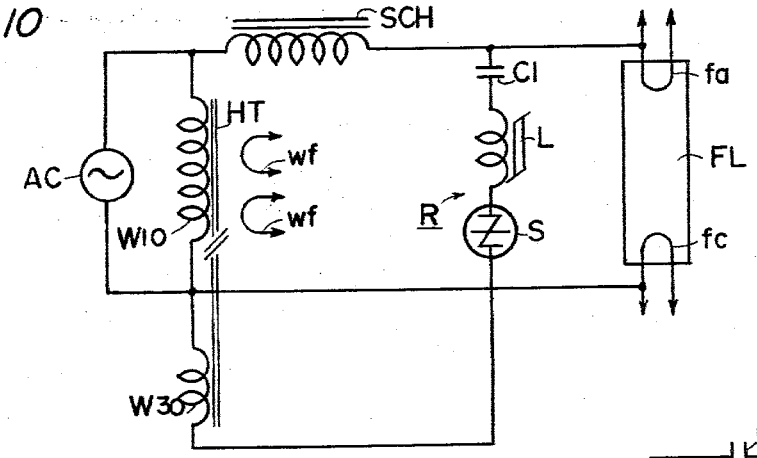
FIG. 10 is a circuit diagram of another practical embodiment according to this invention, which is suited for operation in the second operational mode using a pulse output.

FIG. 10 is an electrical circuit diagram of a further embodiment of this invention, which is well suited for the "pattern II" operational mode. This circuit is used, for instance, to operate a discharge lamp having a low starting voltage. A preheating transformer HT which is connected to the a.c. power source AC has a primary winding W30, filament windings Wf and a tertiary winding W30. The output voltage of the tertiary winding W3 is applied to the booster circuit R, and since it has a voltage multiplying function, a voltage higher than the source voltage is applied to the booster R. This feature is therefore equivalent to substantially lowering the break-over voltage of the thyristor S of the booster. It is to be understood that the "pattern II" operational mode is realized in that the ignition phase angle of the thyristor S is advanced as compared to the source voltage. In addition, the delaying inductor as in the FIG. 9 can be omitted in this embodiment. However, in this circuit, the capacitor C, as shown in FIG. 6, may be connected in parallel to the series circuit of the boosting inductor L and the thyristor S, or the delaying inductor DL, as shown in the FIG. 9, may be connected in series with the capacitor C1 or C and the filament fa.

Figure 11:
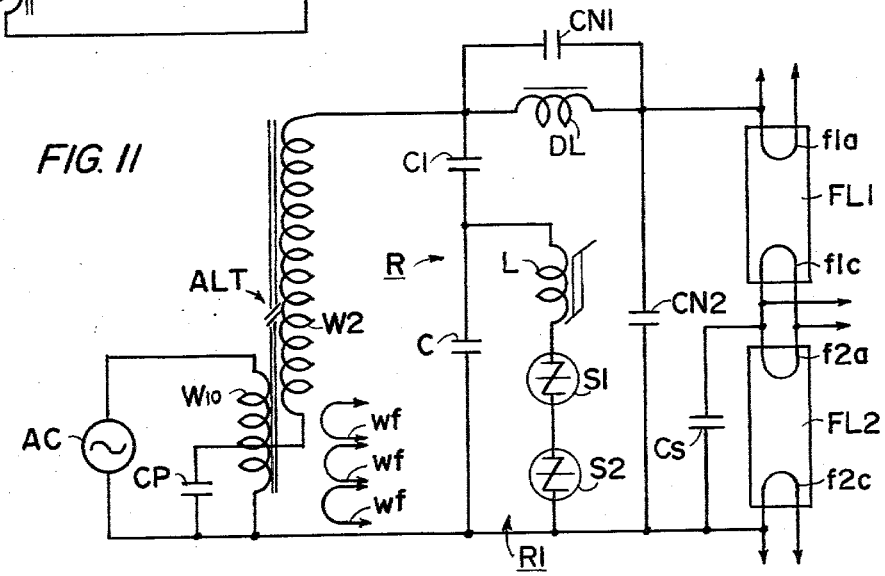
FIG. 11 is a circuit diagram of a further practical modification of FIG. 6, in which a single leakage transformer is used as a current limiting means, and two discharge lamps in series connection are operated in the first operational mode.

FIG. 11 is an electrical circuit diagram of another embodiment of this invention, which is well suited for "pattern I" operational mode, except for the following differences. The single leakage transformer ALT is used in place of the single choke SCH, and the inductance between the primary and the secondary windings is so selected as to be approximately the same as that of the single choke SCH. It is characteristic for this embodiment, that the leakage inductance value is very large compared to that used in the case of the basic circuit. Thus, whether it is a one lamp or a two lamps operating system, when the source voltage and the lamp voltage are substantially the same, the secondary winding W20 which is used in the conventional circuit, can be eliminated by the use of a single leakage transformer. By the way, there must exist some difference between the source voltage and the lamp voltage to increase the current limiting inductance in the circuit using a conventional choke. This is the advantage of using the single leakage transformer according to the invention. In the circuit, two discharge lamps FL1 and FL2 are connected in series. Moreover, a noise suppressing capacitor CN1 is connected in parallel to the delaying inductor DL, and another noise suppressing capacitor CN2 is connected in parallel to the series circuit of the discharge lamps FL1 and FL2. A further capacitor Cs is connected in parallel to the discharge lamp FL2. The capacitor CN1 is used, in cooperation with the delaying inductor DL, in order to make this circuit anti-resonant at, for instance 150 KHz, to thereby suppress a radiation noise. The capacitor Cs is used to start the discharge lamps FL1 and FL2 consecutively.

It is easily understood that the operation of this circuit is based on the same principle as that of FIG. 9. In this case, however, when the high frequency high voltage from the booster R is superposed by the source voltage and supplied to the discharge lamps FL1 and FL2 at the starting instant, the discharge lamp FL1 starts first and then the discharge lamp FL2 starts, due to the presence of the sequential operating capacitor Cs. If only one discharge lamp is used in the operating circuit of FIG. 11, the same effect as described here is achieved.

Figure 12:
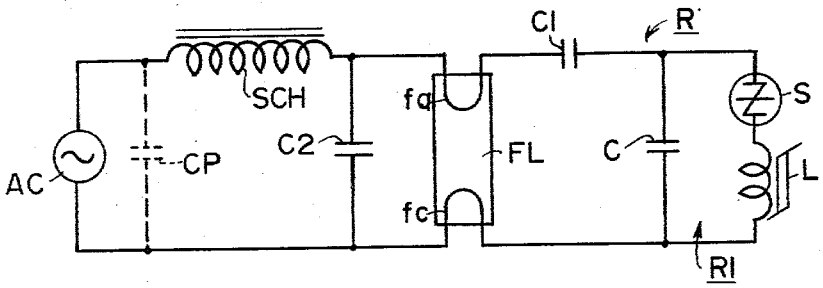
FIG. 12 is a circuit diagra of another basic embodiment according to this invention, in which a preheating circuit is employed.

Although the booster R or the oscillator R1 is employed as a high voltage generating means in the above described examples, these means may be replaced by other high voltage generating circuit components. Moreover, in this case the first and the second ignition are used in common, but the same effect can be obtained when these are separately provided. FIG. 12 shows a basic discharge lamp operating circuit according to the invention which improves the filament preheating effect of the circuit of FIG. 6. The circuit construction and the operational mode of "pattern I" are basically the same as that explained with reference to FIGS. 6 and 7. Therefore, duplicating explanations are omitted here, but the characteristics are that the current generated by the oscillator R1 of the booster R operating as high voltage generating means, preheats the filaments fa and fc of the discharge lamp FL. The current generated by the oscillator R1 is employed to preheat filaments fa and fc in the following three practical embodiments.

In the first embodiment or mode, for instance, the oscillator R1 is connected to the filaments on the side opposite of the voltage source as shown in the circuit of FIG. 6, and the input current is employed for preheating also during the activation of the oscillation circuit. The preheating current of this mode is comparatively small and therefore used only for a limited type of discharge lamps.

The second and the third operational modes, in the filament preheating, are that one oscillation capacitor C and the series circuit of the inductor L and the thyristor S are connected to the side opposite of the voltage source and the other oscillation capacitor C2 is connected to the voltage source side of the filaments fa, fc of the discharge lamp means, and the filament preheating current is thus amplified. The oscillation capacitance comprises two capacitors C and C2. When C is replaced by C2, maximum preheating current is obtained. A high frequency current from the oscillation output vR produced by the booster R flows into the capacitor C2 through the filaments fa and fc, whereby a sufficient preheating of the filaments is achieved. Here, the capacitor CP is employed for the purpose of improving the power factor or as a filter, and by changing one of the junctions from the primary side to the secondary side the capacitor becomes protected against destruction and thus a low cost type capacitor may be used.

Figure 13:
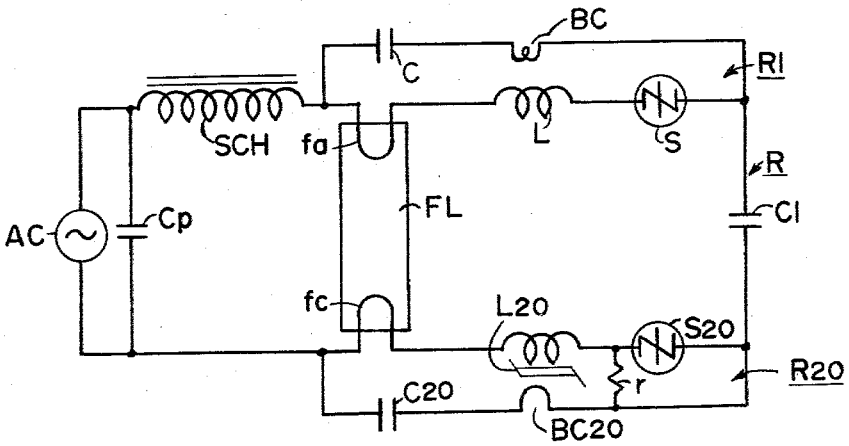
FIg. 13 is a circuit diagram of a modification of FIG. 12, in which a double oscillator booster is used as a high voltage generating means.

FIG. 13 is a circuit diagram of another example of this invention which is suited to a discharge lamp operating system requiring a greater preheating current for the discharge lamp. The oscillation circuit means comprise a first and a second oscillation circuit, or oscillators R1 and R20 forming, in effect, a double oscillating circuit. Each oscillator heats its filament fa or fc individually. The high frequency current flows through the filaments and is considerably amplified by an increased capacitance of the capacitors C and C20 connected in series. Moreover, a leading activation of the booster R is achieved before the ignition of the discharge lamp FL due to the resistor r connected in parallel to the thyristor S20 in the second oscillator R20. The characteristics of the circuit of FIG. 13 are similar to those of the circuit shown in FIG. 12. In this embodiment the capacitor Cp for the improvement of the power factor is connected across the power source AC, and the bias coils BC and BC20 are also added to the boosting inductors L and L20 for obtaining a consolidated output vR. The details and constant values of each component are as follows:

| | |
|---|---|
| FL | hot-cathode type 110-W fluorescent discharge lamp; |
| AC | 200V source voltage of 50/60Hz; |
| SCH | single winding choke coil; |
| CP | 3.5μF preferably connected in parallel to a discharge resistor 1MΩ; |
| C | 0.047μF; |
| C20 | 0.049μF; |
| C1 | 3.3μF (may be used with a discharge resistor 1MΩ in parallel connection); |
| L | 280 turns of which four turns form a bias coil; |
| L20 | 250 turns of which two turns form a bias coil; |
| S, S20 | KIV12 type having VBO of 110~125V; and |
| r | 10KΩ resistance. |

The capacitances of C and C20 have different values to prevent a beat oscillation.

Figure 14:
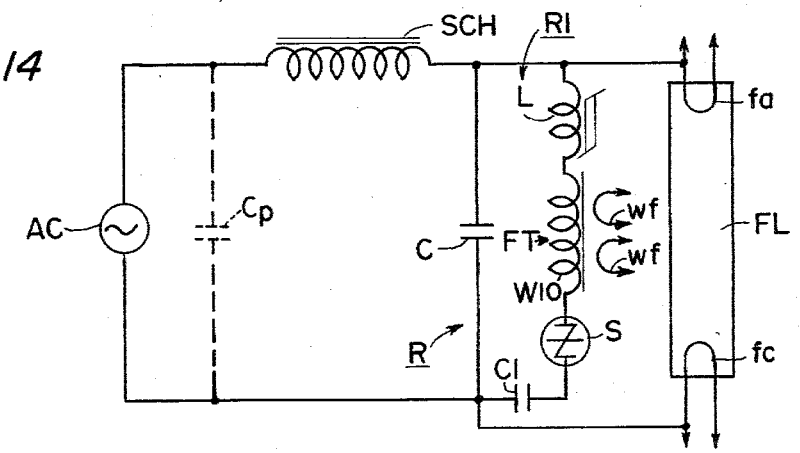
FIG. 14 is a circuit diagram of another modification of FIG. 12 in which a high frequency filament transformer is employed.

Another practical circuit employing a current originating from the high voltage generating means, as a preheat current may be realized in that the filaments of the discharge lamps are preheated by the output of the secondary windings of a high frequency insulating transformer provided within the closed circuit of the oscillation booster circuit R for generating a high frequency high voltage output. FIG. 14 is an electrical circuit diagram showing one of the practical embodiments using such a high frequency insulating transformer. The construction and the operation is similar to the embodiment of FIG. 6, hence a detailed explanation is omitted here. The difference resides in that the booster R is connected to the source side, and the capacitor C1 is provided within the oscillator R1 as compared to FIG. 6. The booster circuit may be connected to the opposite side of the source, and, in addition, the intermittently oscillating capacitor C1 may be serially connected to the oscillator R1, as shown in FIG. 6.

The characteristics of this operating system reside in that the filament transformer FT is provided within the booster R and the primary winding W10 is connected between the inductor L and the thyristor S. This transformer FT is constructed by winding the primary winding W10 around a ferromagnetic core such as a ferrite core, to which the secondary windings, i.e., the filament windings Wf are coupled. The filament windings are connected to the respective filaments fa and fc of the discharge lamp FL. In operation, during the period when the oscillator R1 is activated, the oscillation output vR is applied to the discharge lamp FL and at the same time induced within the filament windings Wf of the filament transformer FT which preheats the filaments fa and fc of the discharge lamp. Thus, both filaments are sufficiently preheated by the current which is greater than the input current of the booster circuit R. When the filaments fa and fc are sufficiently preheated, the discharge lamp FL is started or ignited by the oscillation output vR.

Figure 15:
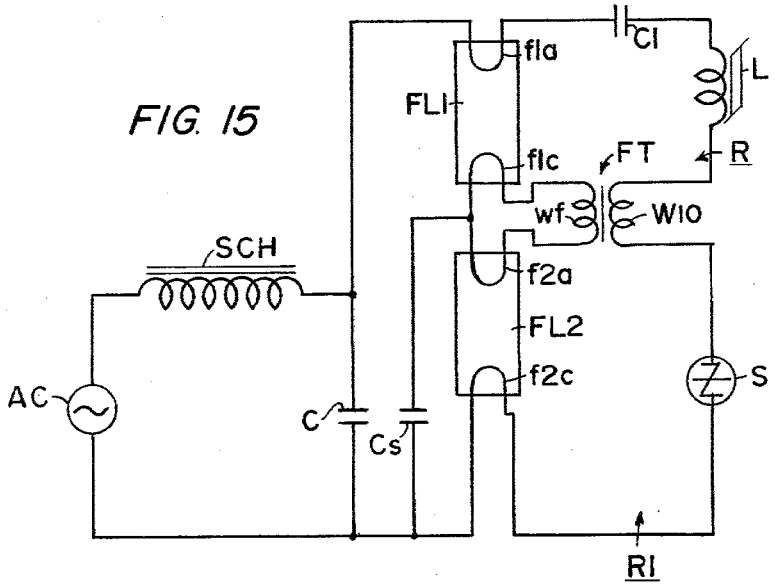
FIG. 15 is a circuit diagram of a modification of FIG. 14 for operating two discharge lamps.

FIG. 15 is an electrical circuit of a modification of FIG. 14 of this invention, wherein the two discharge lamps FL1 and FL2 are connected in series and operated sequentially. The filaments f1c and f2a of the two discharge lamps FL1 and FL2 are connected in series as shown or they may be arranged in parallel connection. In any event f1c and f2a are connected to the secondary winding Wf of the filament transformer FT. In addition, a capacitor Cs for the sequential ignition is also provided at this connection.

The oscillation capacitor C is connected to the source side of a series circuit of the discharge lamps FL1 and FL2, while a series circuit of the intermittently oscillating capacitor C1, the backswing boosting inductor L and the thyristor S is connected to the opposite side of the discharge lamps. In this circuit of a closed booster R or the oscillator R1 the primary winding W10 of the filament transformer FT is connected in series to the boosting inductor L. In operation, when the source AC is switched on, the source voltage e is applied to the booster R, and the booster R is activated so as to generate a high voltage oscillation output vR and to impress the output on the series circuit of the discharge lamps FL1 and FL2. When the thyristor S is in the non-conducting state, the capacitor C is charged, and when the thyristor S goes into the conducting state, the electrical charge flows through the following circuit: capacitor C—filament f2c—thyristor S—primary winding of the filament transformer FT—boosting inductor L—intermittently oscillating capacitor C1—filament f1d—capacitor C. Therefore, the filaments f1a and f2c are rapidly heated by the superposed current of a low frequency current from the source AC and a high frequency current originated by the discharge current of the capacitor C.

Meanwhile, during the oscillation period a high frequency voltage is induced in the primary winding W10 of the filament transformer FT, which is a high frequency insulating transformer, provided in the closed booster circuit R with the filament winding Wf. The filaments f1c and f2a which are located at the connection of the two discharge lamps FL1 and FL2, are thus preheated in series by the high frequency current induced in the secondary winding Wf of said filament transformer FT.

Therefore, the discharge lamps FL1 and FL2 are sequentially ignited by the function of the capacitor Cs. The discharge lamp FL1 fires first and then follows the other discharge lamp FL2. The filaments f1a and f2c are preheated by a current resulting from the superposition of the low frequency power source current and the high frequency current of the oscillator R1. Therefore, a large size power transformer for the filament preheating as shown in FIGS. 9 to 11, is not required in FIG. 15. Thus, miniaturization, one of the advantages of every half cycle discharge lamp operating systems is easily realized, resulting in a low cost production. In addition, the sequential igniting capacitor Cs of the above described circuit of FIG. 15 may be eliminated.

When the high frequency transformer is connected to all filaments, the base-pin current of the discharge lamp is divided into two parts during lamp operation, thus achieving a simplification of the base pin construction. In this case the filaments f1c and f2a are connected in series to the secondary winding Wf of the filament transformer FT, however, they may be connected in parallel, if desired.

In order to stabilize the ignition, delaying means or other means assuring precedence of the activation of the booster circuit prior to ignition of a discharge lamp is connected between the current limiting means and the discharge lamp means, regardless whether it is a hot cathode type or a cold cathode type to regulate the ignition sequence in the discharge lamp operating system of the present invention. For instance, when time delay means are employed, the source a.c. voltage 1 activates the booster R first, then follows the ignition of the discharge lamp FL due to the high voltage output vR and the source voltage from the current limiting means delayed by the delaying means. That is, the ignition of the discharge lamp always follows after the booster circuit ignition in every half cycle of the source voltage e, and even when the source voltage e becomes twice as high as the lamp voltage, the booster R is activated at first. Therefore, a stable "every half cycle igniting operation" is assured prior to the lamp ignition. The following components may be used as time delay means, an unsaturated inductor, a saturable inductor, a combined circuit of an unsaturated inductor and a noise preventing capacitor, or a four terminal circuit network composed of two coils arranged to compensate the generated voltage by a series connection or a delaying circuit employing semiconductor means may also be used. For instance, when SSS is employed as a delay means, the ignition time dealy is determined by its break-over voltage. The function of such time delay means is to regulate the ignition sequence of the booster circuit and the discharge lamp means so that the booster circuit is activated earlier, which is equivalent to delaying the reignition of the discharge lamp. Therefore, for instance, when two booster circuits as shown in FIG. 13 are employed and sequentially activated, it functions as a regulating means of the ignition sequence.

Figure 16:
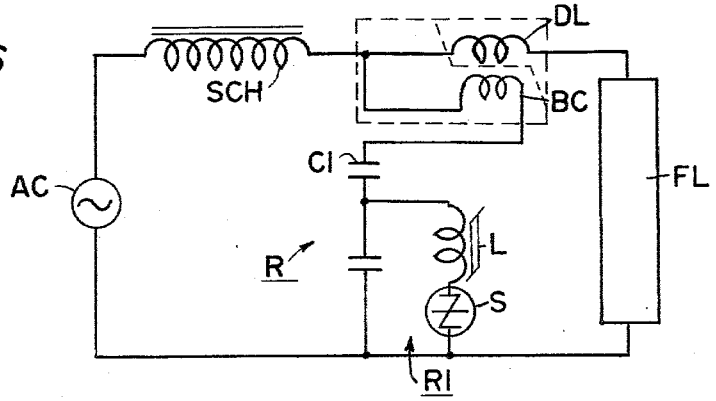
FIG. 16 is a circuit diagram of a further embodiment for operating a cold cathode discharge lamp according to this invention.

FIG. 16 is a circuit diagram of a further embodiment of the present invention containing such time delay means. The construction is similar to that of the practical circuits described above, but in FIG. 16 a cold cathode type discharge lamp FL is connected to the booster R through a blocking or delaying inductor DL. A bias coil BC which is activated by the current of the oscillator R1 is magnetically coupled to this blocking inductor DL. The bias coil BC which is connected in series to the intermittently oscillative capacitor C1, is positively biased and increases the inductance of the blocking inductor DL when activated.

In operation, when the source AC is switched on, the source voltage e is applied to the booster R through a single winding type choke coil SCH and the oscillation circuit begins to oscillate. On the other hand, the source voltage e to the discharge lamp FL is blocked by the delaying inductor DL.

Now, as current flows through the bias coil BC due to the input current of the oscillator R1, an increase in the effect of the delaying inductor DL results. The blocking of the oscillation output vR due to the delaying inductor DL becomes more effective and the start or the ignition of the discharge lamp FL is delayed. In this context it will be appreciated that the miniaturization of the delay inductor DL has been achieved. According to this circuit, a very stable operation of the discharge lamp is assured due to "the every half cycle ignited system", even if variations of the lamp voltage occur due to the variation of the source voltage and of the ambient temperatures.

Although the invention has been described with reference to specific example embodiments, it will be appreciated, that it is intended to cover all modifications and equivalents within the scope of the appended claims.

I claim:

1. A discharge lamp operating system for sustaining the lit condition of discharge lamp means, comprising an electrical a.c. power source having a given low frequency, lamp current limiting means connecting said a.c. power source to said discharge lamp means for establishing lighting conditions for said discharge lamp means, and reignition means connected across said discharge lamp means, said reignition means comprising oscillator circuit means (R1) and an intermittently oscillating capacitor (C1) supplying an intermittent output, having a frequency higher than said given low frequency, directly to the discharge lamp means immediately after every pause period of every half cycle whereby the reignition means sustain said lit condition by the intermittent output current of said oscillator circuit means which sustains a constant reignition voltage even if the a.c. power source should supply a varying voltage, whereby the oscillator circuit means constitute a self-oscillating independent high frequency output power source, said current limiting means comprising a single winding current limiter, wherein the voltage of said a.c. power source is established below the required reignition voltage of said discharge lamp means during its operation, whereby said discharge lamp means is reignited by supplying an initial discharge lamp current value as an input current to said reignition means in every half cycle of said a.c. power source, so that the lit condition is substantially independent of the effective voltage of said a.c. power source.

2. The operating system of claim 1, wherein said single winding current limiter is a choke coil having end terminals only.

3. The operating system of claim 1, wherein said single winding current limiter is a leakage inductance of a transformer.

4. The operating system of claim 1, wherein said discharge lamp means comprise a plurality of discharge lamps serially connected and sequentially ignited in operation.

5. The operating system of claim 1, wherein said reignition means comprises an oscillator and an intermittently oscillating capacitor, said oscillator including an oscillation capacitor and a series circuit of a switching means and a boosting inductor in parallel connection, and wherein said reignition means is energized by said power source to generate an intermittently high frequency high voltage output, at a point of time just prior to ignition of said discharge lamp means.

6. The operating system of claim 5, wherein said switching means comprises one or more bi-directional two terminal thyristors having an effective break-over voltage higher than the lamp voltage of said discharge lamp means and lower than the voltage of said power source.

7. The operating system of claim 5, wherein time delay means are connected between said discharge lamp means and said current limiting means whereby the ignition phase of said reignition means is controlled at every half cycle of said power source prior to the ignition of said discharge lamp means.

8. The operating system of claim 7, wherein said time delay means include an inductor and means for changing the inductance of said inductor in response to the activation of said reignition means.

9. The operating system of claim 8, wherein said means for changing the inductance is a bias coil which is energized by the current flowing through said reignition means and at the same time acts as a bias winding by a magnetic coupling with said inductor.

10. The operating system of claim 5, wherein said discharge lamp means is a hot-cathode type discharge lamp having a filament, and further comprising a preheating circuit for said filament, said preheating circuit including said filament located within said reignition means so as to flow current through said filament.

11. The operating system of claim 10, wherein said preheating circuit includes a high frequency insulating transformer located within the closed circuit of said reignition means, said insulating transformer supplying a part of the energy output from said reignition means to said filament of said discharge lamp.

12. The operating system of claim 11, wherein a plurality of discharge lamps are employed in series connection, and wherein at least a part of the oscillation energy output of said reignition means is supplied to said filaments of said series connected discharge lamps by said high frequency insulating transformer.

13. The operating system of claim 10, wherein said reignition means comprises two oscillators in series connection, each of said filaments of said discharge lamp means being located within each of said oscillators so as to promote the preheating of said filaments.

14. The operating system of claim 10, wherein one of said oscillators includes sequentially operating means for the activation of said oscillators.

* * * * *

UNITED STATES PATENT OFFICE

CERTIFICATE OF CORRECTION

Patent No. 4,238,708 Dated December 9, 1980

Inventor(s) Isao Kaneda

It is certified that error appears in the above-identified patent and that said Letters Patent are hereby corrected as shown below:

--[30] Foreign Application Priority Data

Feb. 2, 1977 [JP] Japan .....52-11040
Mar. 17, 1977 [JP] Japan .....52-30065
Mar. 23, 1977 [JP] Japan .....52-35128--.

Signed and Sealed this

*Twenty-fourth* Day of *February 1981*

[SEAL]

*Attest:*

RENE D. TEGTMEYER

*Attesting Officer*

*Acting Commissioner of Patents and Trademarks*